United States Patent [19]

Slagle

[11] Patent Number: 5,027,709

[45] Date of Patent: Jul. 2, 1991

[54] MAGNETIC INDUCTION MINE ARMING, DISARMING AND SIMULATION SYSTEM

[76] Inventor: Glenn B. Slagle, 7100 Sea Cliff Rd., McLean, Va. 22101

[21] Appl. No.: 617,470

[22] Filed: Nov. 13, 1990

Related U.S. Application Data

[63] Continuation of Ser. No. 515,779, Apr. 26, 1990, abandoned, which is a continuation of Ser. No. 385,023, Jul. 18, 1989, abandoned.

[51] Int. Cl.[5] ..... F42B 8/28; F42C 13/08

[52] U.S. Cl. ..... 102/427; 102/293; 102/401; 434/11

[58] Field of Search ..... 102/293, 401, 417, 426, 102/427; 434/11

[56] References Cited

U.S. PATENT DOCUMENTS

| | | | |
|---|---|---|---|
| 2,411,787 | 11/1946 | Hammond, Jr. | 102/427 |
| 3,017,834 | 1/1962 | Park et al. | 102/417 |
| 3,019,730 | 2/1962 | Maltby et al. | 102/417 |
| 3,020,843 | 2/1962 | MacDonald et al. | 102/417 |
| 3,170,399 | 2/1965 | Hinman, Jr. | 102/427 |
| 4,690,061 | 9/1987 | Armer, Jr. et al. | 102/401 |

FOREIGN PATENT DOCUMENTS

| | | | |
|---|---|---|---|
| 2165928 | 4/1986 | United Kingdom | 102/401 |

*Primary Examiner*—Deborah L. Kyle

*Attorney, Agent, or Firm*—Werten F. W. Bellamy; Anthony T. Lane

[57] ABSTRACT

A system for powering and communicating with a mine or mine simulator, involving magnetic induction coupling between a powered search unit with a resonating primary inductance coil and a secondary inductance loop in the mine device. The current in the secondary loop is rectified in the mine device to provide dc power. The magnetic induction frequency can be in the range from 40 kHz to 1 MHz. The search unit can resonate sequentially or simultaneously at different frequencies, and rectification of the different frequencies in the mine device can provide information to the mine device. Feedback to the search unit can be by the mine device modulating the impedance of its secondary loop, for instance at an audio frequency 1/10th of the frequency of the induction coupling, and by detecting in the search unit the corresponding change in the reflected impedance. A mine device can be armed or disarmed, and report on its status when queried by the search unit coming sufficiently close to the mine device. A mine device can have a selectable active period during which it can kill a tank and provide a corresponding kill signal to the tank crew, be limited to only one kill, delay its arming to allow its planting or withdrawal of the search unit providing the arm signal, etc. A kill signal can be received with a 10 watt power input into a search unit on a tank, while maintaining a clearance of 5 feet from the ground.

20 Claims, 9 Drawing Sheets

MAGNETIC INDUCTION MINE ARMING, DISARMING AND SIMULATION SYSTEM

GOVERNMENT INTEREST

The invention described herein may be manufactured and used by or for the U.S. Government for governmental purposes without the payment of any royalties therefor or thereon.

This application is a continuation, of application Ser. No. 07/515,779, filed 04/26/90, now abandoned. Which is a continuation, of application Ser. No. 07/385,023, filed 07/18/89, now abandoned.

BACKGROUND OF THE INVENTION

The invention relates to wireless power transmission systems for interrogation, control and powering of remote or isolated circuitry, by magnetic induction coupling to such circuitry. The invention is particularly directed to the powering and control of mine devices, and more particularly to mine simulation devices and systems for war game exercises involving tanks, trucks and other vehicle types.

It is not always feasible or possible to provide a remote or isolated circuit with its own internal power, or to have a wired connection to such isolated or remote circuit to provide it with power or to control its status and function. Also, it is not always feasible to interrogate and control such stand-alone circuitry by radio means.

It is desirable to provide a mine simulator that is capable of reliably communicating to the crew of a tank or other armored vehicle the fact that they have run over a mine and are "dead" for the duration of the training exercise. Prior art mine devices typically have included a battery as a power source, as in U.S. Pat. Nos. 3,017,834, 3,019,730 and 3,020,843. Previous attempts at antitank mine simulators using smoke grenades and acoustic devices have been unsuccessful due to the inability of the crew of a tank to see or hear such devices when they are run over. Mine simulators utilizing a small internal fuse-activated VHF radio transmitter triggering a tank-mounted receiver have been developed. Such radio transmitter types of mine simulators have also required internal batteries, which have a limited shelf and operating life. This makes the cost of operating a simulated minefield relatively expensive.

Additionally, there is a danger that a radio transmitter in a mine simulator, even one of very low power, may on occasion "kill" one or more tanks other than the one which just ran over it, due to variable radio propagation effects in the vicinity of a large metal tank hull. From a logistical standpoint, it is also desirable that the simulated mine be as low in cost as possible and require no more preparation for seeding by troops than a real mine. Additionally, it is desirable to minimize the possibility of the simulated mine killing vehicles other that the first one to run over the mine.

Improved mine simulation systems are of interest to armed forces around the world. The evolution of modern warfare creates demand for "smart" mines and other devices, with capabilities of advantage to friendly forces and disadvantage to enemy forces, and creates a need efficiently training soldiers to deal with such next-generation devices.

SUMMARY OF THE INVENTION

The invention provides means for powering and communicating with a remote or isolated circuit without a connection with wires, using coupled magnetic induction, such as between a tank with a search unit mounted on it and a buried mine device.

The invention provides for wireless power transmission utilizing coupled magnetic induction, enabling the use of a mine simulator that requires no batteries yet can transmit coded signals to a tank in the process of running over the mine.

The invention offers an improved certainty for war game purposes, since all communications can be provided without wires, and with virtually no possibility of a mine simulator killing more than one tank, as a result of limiting the kill signal and also as a result of the greater drop-off with distance of a magnetic dipole field as compared to an electric dipole field.

The invention is directed to providing safer and more realistic simulation in training for antitank mines in war games and other troop training exercises, involving tanks, trucks and other types of vehicles.

The invention overcomes a primary problem in mine field exercises with armored vehicles, that of poor visibility by the crew in a buttoned-up tank and their inability to hear outside sounds.

The invention is directed to the powering of and communication with smart mine devices, including for selectably arming and disarming a mine device, and for selectably delaying the mine device from entering the armed status when it can issue a kill signal.

The invention is generally directed to enabling the powering of and communication with all types of remote or isolated devices, wherein the device is powered by induction magnetic coupling, and information is accordingly enabled between the device and a portable source of the magnetic field for the induction coupling.

DESCRIPTION OF PREFERRED EMBODIMENTS

The invention is described in detail in connection with the following embodiments and the drawings, which are intended as exemplary only and not limiting.

Figure 1:
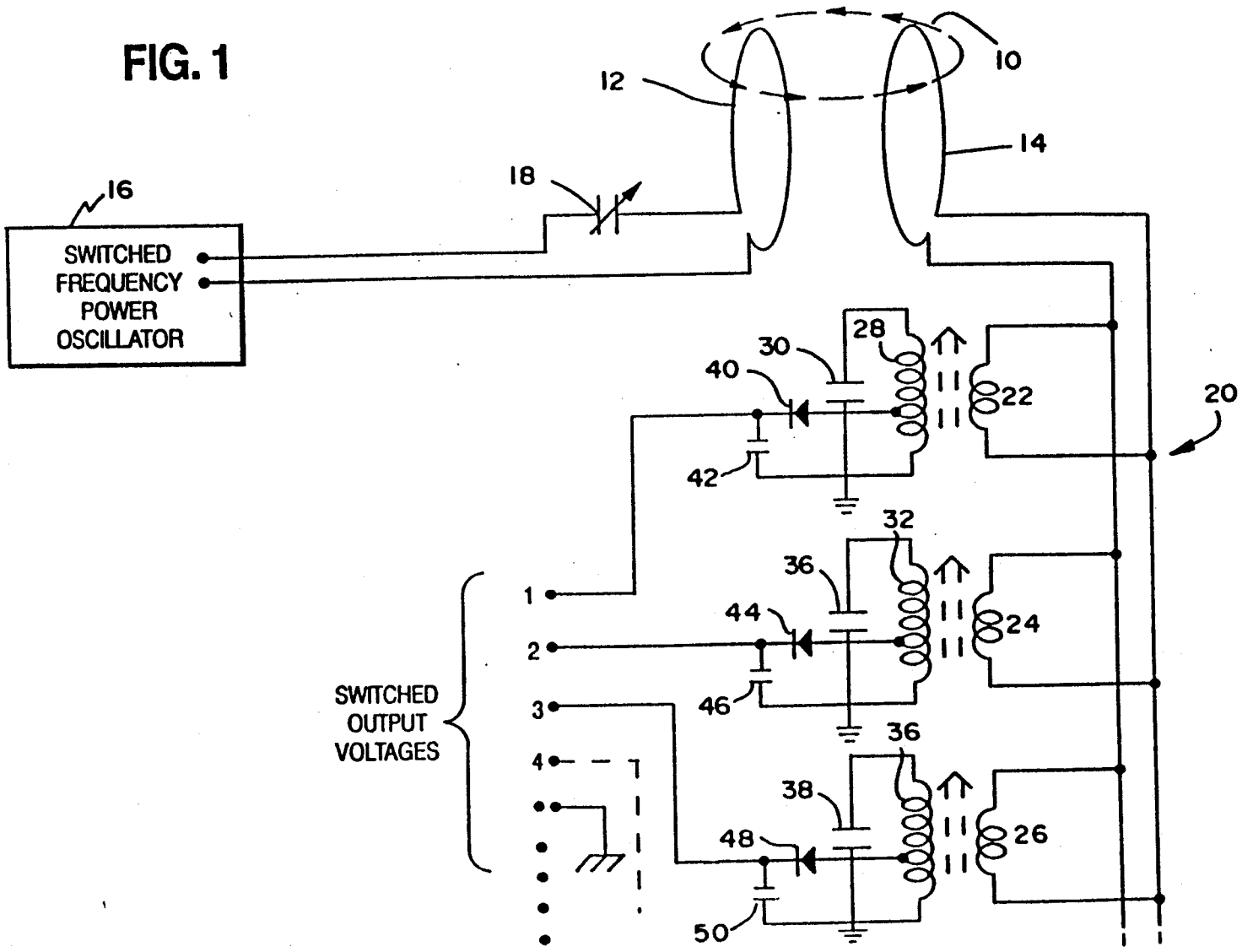
FIG. 1 shows schematically the magnetic induction coupling for power transfer between a primary and a secondary loop, where resonance is provided for on both sides for the desired frequencies of the oscillating magnetic field which is powered from the primary side, with each frequency being separately rectified on the secondary side.

The present invention allows the transmitting and switching of power, and accordingly the transfer of information, by means of magnetic induction coupling 10 between a primary coil 12 in a powered unit and a secondary coil 14 in an isolated unit. As shown in FIG. 1, an embodiment of the present invention transmits and switches power by means of magnetic induction coupling 10 through the use of a switched frequency power oscillator 16 coupled to loop 12 through a primary resonating condenser and driving a single or multiple turn loop inductor that is resonated at each of the switched frequencies of the power oscillator. The coupling of the oscillating magnetic dipole field depends on the proximity, relative size and orientation of the power reception loop in the remote device. Thus, by magnetic induction, there is provided a wireless power transmission and switching system for the powering and control of an isolated or remote circuit.

A sequence of frequencies can be selected or predetermined, depending on the function to be served, and as provided for in the isolated circuit. The primary resonating condenser 18 is adjusted for resonance in the primary loop at each frequency, or a respective capacitor can be automatically switched into the series connection with the primary loop for each frequency. If means is provided in the primary loop, a plurality of frequencies can be simultaneously inductively coupled with the secondary loop, and simultaneously detected at the respective rectified outputs illustrated.

In the isolated circuit 20, the resulting alternating magnetic flux can be coupled either directly or as illustrated via a coupling link 22, 24 or 26 to a respective high-Q resonant circuit formed with a respective capacitor/inductor series pair 28 and 30, 32 and 34, or 36 and 38. Each such resonant circuit in the remote device is resonant at a different switched frequency of the power oscillator. Direct current voltages can be obtained from each resonant circuit by tapping the coil of each resonant circuit to obtain the desired impedance and using a diode and capacitor rectifier/filter combination 40 and 42, 44 and 46, or 48 and 50 to convert the high frequency alternating current in the coil at resonance to direct current. The frequency of each magnetic induction field can be selected in the radio frequency range, such as in the range from 40 kHz to 1 MHz, or can be selected from a smaller range to avoid interference with frequencies reserved for communication, etc.

Therefore, the net result of switching the frequency of the power oscillator in the powered unit is a switching of DC voltages from one circuit to the next or from one part of a circuit to another, in the isolated unit. Since this system can be provided so as to remotely switch power by means of passive components, it can be more resistant to nuclear radiation or extreme temperatures than for instance C-MOS logic circuitry.

Figure 2:
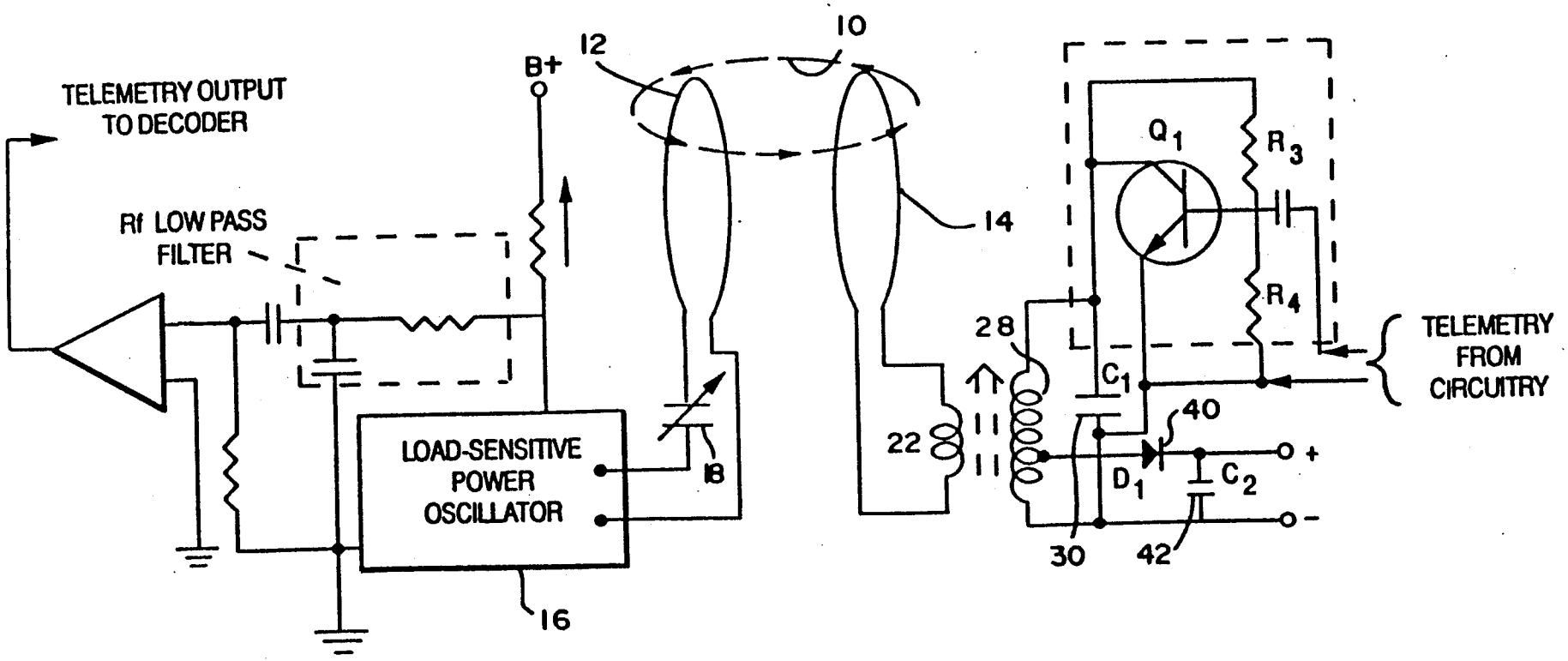
FIG. 2 shows schematically how telemetry data from an isolated device powered by inductive coupling can be received via a load sensitive oscillator producing the coupling field and a filter, as a result of modulating the load in the isolated device with the telemetry data to be transmitted.

FIG. 2 shows another embodiment of the present invention, combining the wireless transmission of power with data reception for interrogation of the isolated or remote circuitry being powered. The data is transmitted and received in this system by modulating either the loading or tuning of one of the resonant circuits in the isolated circuit with telemetry data generated in the isolated circuitry. When the load sensitive power oscillator on the primary side is tuned and coupled to a resonant circuit in the isolated unit 20 and is operating in the class B or C mode, any variation of the loading or tuning of that resonant circuit will cause a corresponding variation in the plate or collector current of the power oscillator in the primary side. Hence, telemetry data from isolated circuitry can be received by detecting the resulting modulation in the plate or collector current of the power oscillator.

Figure 3:
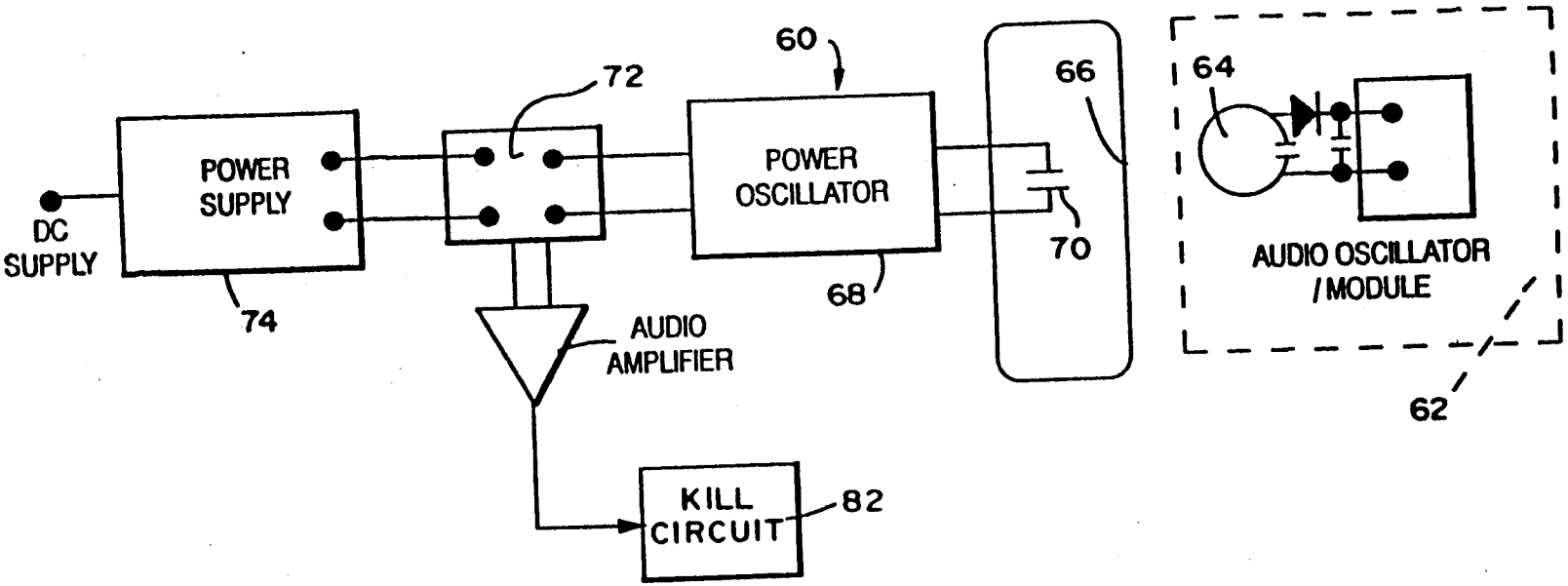
FIG. 3 shows schematically various general parts of an embodiment of the system of the present invention, including a search unit to which power must be supplied and which is generally mounted on a vehicle, and a mine simulator having a pickup coil to be coupled by magnetic induction to the search coil of the search unit.

FIG. 3 shows schematically a magnetic induction system according to an embodiment of the present invention, comprising a search unit 60 and a mine simulator 62. The mine simulator 62 in this embodiment modulates the impedance of its pickup coil 64 (secondary loop) at an audio frequency, when powered by magnetic induction coupling with the search unit, thus effectively transmitting a kill signal as a result of the search unit coming sufficiently close to the mine simulator. The search unit contains the search (primary) coil 66 driven by the power oscillator 68 and resonating condenser 70 and a receiver/demodulator 72 for detecting the difference in the load current of the power oscillator at the audio frequency, for detecting the kill signal from the mine simulator. The search unit is powered by a dc supply 74, as an example.

Figure 4:
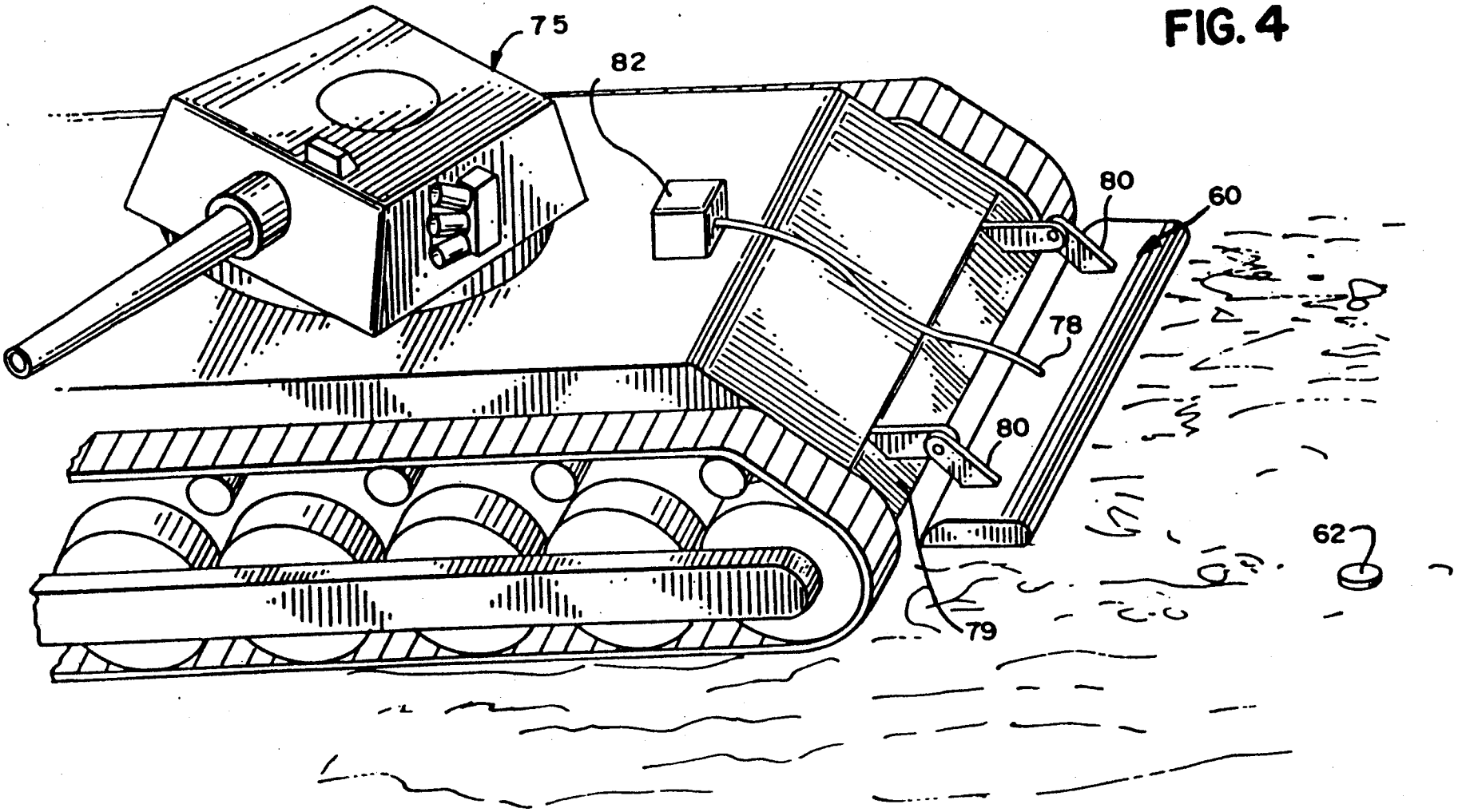
FIG. 4 indicates the mounting of a search unit fore or aft on a tank for setting off the mine simulator buried in or lying on the ground in the path of the tank, with the power supply and kill indication circuitry mounted separately on the tank.

FIG. 4 shows the search unit 60 of FIG. 3 mounted on a tank 75, with the mine simulator 62 on or a few inches in the ground. The search coil is contained in a housing 78, made for instance of an airimad or other strong and light material. The housing 78 is suspended either fore or aft of the tank, using for instance mounting lugs 80 formed in the housing. In this embodiment the power supply and kill indication circuitry 82 is mounted separately from the housing for the search coil. In another embodiment, this circuitry could be mounted on the housing and connected by a cable to the tank's power supply, thus allowing for rapid mounting of the search unit 60 as one piece on the tank. The search unit 60 could also be mounted on any other vehicle, or even hand-carried as long as a power supply for the search unit is available. The search coil 66 is preferebly held in the housing in a position so that the coil is parallel to the ground, and the coil in the mine simulator 62 is similarly horizontally oriented, although such orientations of the coils are not necessary, the possible inductive coupling between the coils being generally the determining factor. In another embodiment, the housing may be partly or entirely eliminated, as where the search coil is suffiently self-supporting.

The resonant search coil mounted on the hull of the tank is driven for instance by a 60–100 kHz power oscillator 68, so as not to interfere with communications. Both the power oscillator 68 and a special 60–100 kHz receiver 72 with input connected to the search coil are powered by the tank's electrical system (24–28 v). The output of the receiver is fed to kill-indication circuitry 82 inside or outside of the tank. As mentioned, the power oscillator/receiver electronics can be integrated within for instance the central, top part of the housing for the search coil, for rapid system installation. The housing for the search coil can have dimensions of for instance 4 to 5 feet by 1.5 to 2 feet wide, while the mine simulator can have a diameter of roughly 5 inches. The dimensions of the search coil 66 in the housing 78 and of the pickup coil 64 in the mine device are correspondingly somewhat smaller. The ratio of the cross-sectional areas of the primary and secondary loops can be up to a factor of 100 or larger. In the embodiment illustrated in FIG. 4, the housing 78 is spaced a few inches from the tank hull 79.

Figure 5:
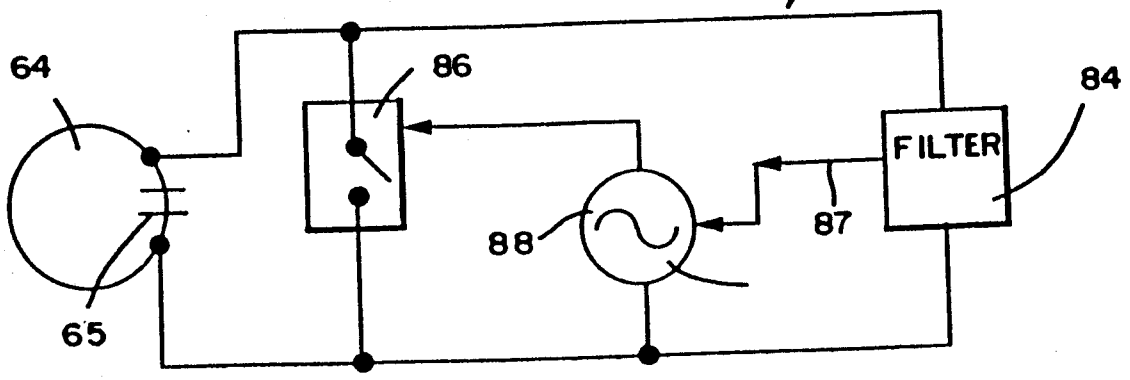
FIG. 5 shows schematically the general features of an embodiment of a mine simulator.

The mine simulator 62 is formed as an encapsulated pickup coil 64 resonated by means of a capacitor 65 at the same frequency as the power oscillator-driven search coil. As shown in FIG. 5, this pickup coil 64 is also connected to a rectifier-filter unit 84 and to a reactance modulator 86. The rectifier/filter unit supplies dc power to an audio oscillator 88 via line conductor 87, and the audio oscillator 88 controls the reactance modulator 86 to vary the load on the resonating pickup coil. All of these components are encapsulated together to form the mine simulator 62. In operation, when a tank 75 with the search coil system drives over a mine simulator 62, sufficient magnetic induction coupling occurs between the search coil 66 and the pickup coil 64 to power the oscillator and modulator circuitry in the mine simulator 62. The resulting low-level modulation of the search coil rf magnetic field is picked up by the tank-mounted receiver and fed to the kill indication circuitry. Tests have shown that sufficient power is induced in the mine simulator coil rectifier-filter 84 by the search coil 66 to allow employing C-MOS logic circuitry in the mine simulator 62. Such circuitry can be used to simulate mine arming/self destruct delays, as well as other possible control and reporting functions. Such control and reporting functions can also be incorporated into other devices, such as actual mines having "smart" features not provided for in present mine technology.

Figure 6:
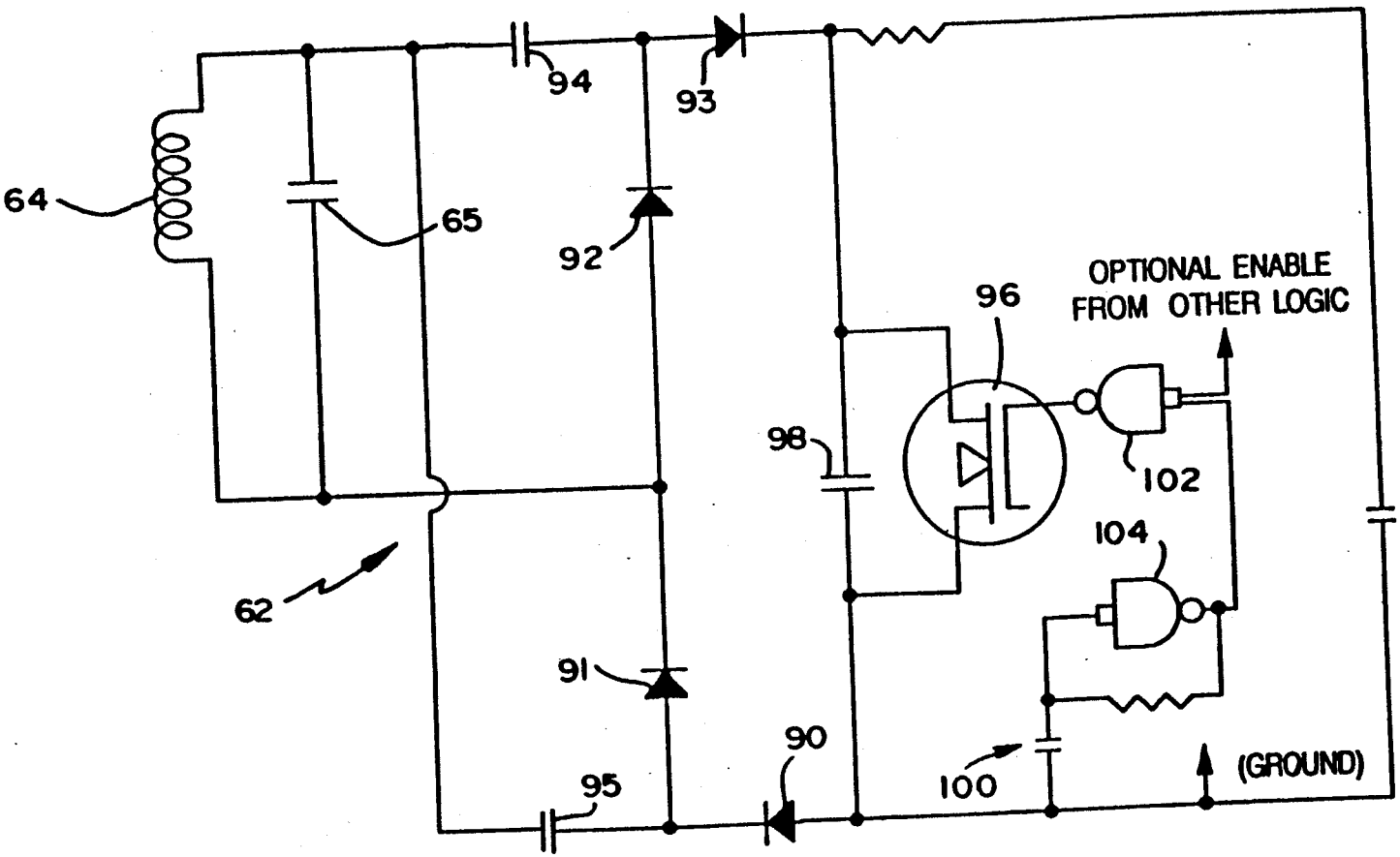
FIG. 6 shows schematically an embodiment of a mine simulator, with a voltage quadrupler in the rectifier/filter, and a power FET for the reactance modulation as driven by the audio oscillator and any other enabling logic in the mine simulator.

FIG. 6 shows a more detailed schematic for an embodiment of the mine simulator of the present invention. The pickup coil 64 is formed for instance of 20 turns of AWG #20 wire in a 5 inch loop. The fast-switching diodes 90 to 93 are connected in a bridge with a pair of 0.01 μf capacitors 94, 95 to provide a rectifier/filter which acts as a voltage quadrupler. A power FET (such as the indicated Hex FET IRF-11) modulates the reactance of the mine simulator 62 as seen by the search unit. The 0.001 μf capacitor 98 connected across the outputs of the power FET is optional, for the filtering function.

The control input of this power FET 96 is operatively connected to the output of the audio oscillator 100 in the circuit, which optionally can be enabled by other logic provided in the mine simulator as indicated by one of four stages in the industry-standard chip device 102 (CD4093, quad 2-input NAND Schmidt trigger). Another stage 104 of this standard device is employed as a Schmidt trigger in part of the audio oscillator, as indicated.

All the circuitry is encapsulated in a disc 1 inch thick and 5 inches in diameter, with steel-filled epoxy as the encapsulant. The resonating capacitor and the pickup coil are selected to resonate at the frequency of the search coil in the search unit.

Figure 7:
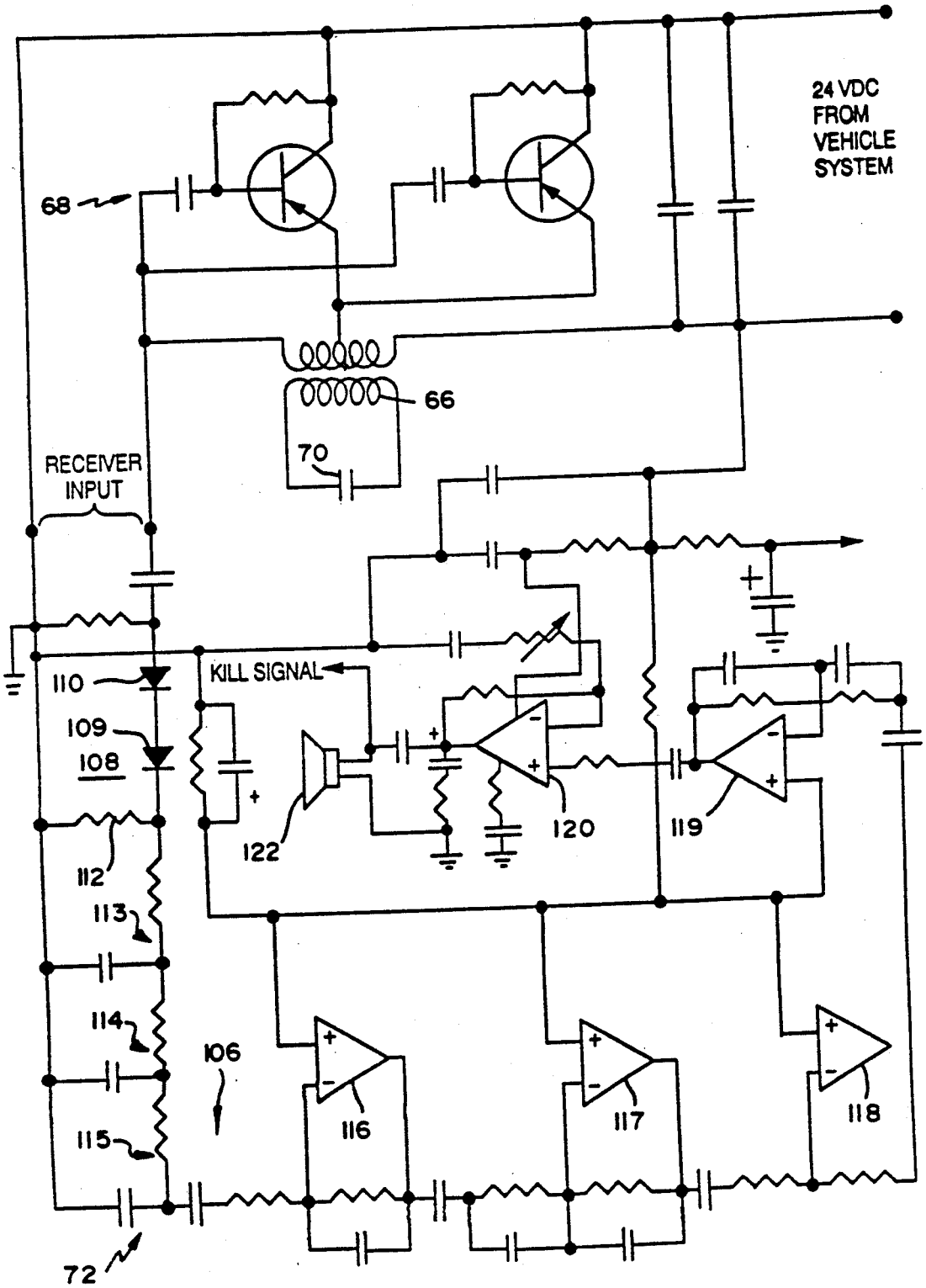
FIG. 7 shows schematically an embodiment of a search unit, including the powering of the primary loop (search coil) and the receiver for detecting the kill signal from the reflected impedance changes in the secondary coil of a mine simulator, to provide both an audio and an electrical output.

FIG. 7 shows in greater circuit detail one embodiment of the search unit according to the present invention, the main components of which are the search coil 66, the power oscillator 68 which is connected as a Hartley oscillator to drive the search coil, and the receiver. The search coil is made for example of 9 turns of 3 mm diameter aluminum wire wound on a 17 inch by 48 inch rectangular form. The receiver could also be connected across the search coil itself, across the 0.03 μf resonating capacitor 70 connected in series with the search coil, or across a resistor connected in series with the dc power supply to detect change in the load current to the search coil caused by change in the coupled impedance as reflected via the inductive coupling from the mine simulator. As illustrated by the respective components in FIG. 7, the receiver first provides a high pass filter 106 (2000 pf shunted by 10 kΩ, as shown), for example to reject dc and any 60 cycle signals. Following the illustrated rf detector 108 (two high speed diodes 109, 110 in series, each having for instance a breakdown voltage of 50 v, such as 1N914 diodes) and a dc return path (10 kΩ) resistor 112 to ground, it then out the rf resonance frequency of the search coil (three RC stages 113, 114, 115 in series), leaving the audio frequency of the kill signal from the impedance modulation in the mine simulator to be amplified by the four indicated stages 116, 117, 118, 119 of the audio amplifier chain, using again the stages of a standard chip device (LM324) as an example. Each such illustrated amplification stage provides a gain of about 10, the circuitry on the input of each stage attenuating the low frequencies and the feedback connected components on each stage attenuating the high frequencies. The passband of the audio amplifier chain is about 2 kHz.

The dc supply powers the audio amplifier chain, and a final power amplifier 120 PA for the audio signal which is the kill signal, after the decoupling filtering by the indicated circuitry. The kill signal is shown to be output both as an electronic signal and as an audio signal from the speaker SPKR 122. The receiver circuitry must have a response to the audio signal that is faster than any change in any field or charge stored in the system due to the motion of the tank.

For the tank-mounted search unit and mine simulator embodiments shown in FIGS. 6 and 7, and as described in connection with FIG. 4, tests have shown that the search unit can successfully receive kill signals from a mine simulator at a distance of 5 feet perpendicular to the plane of the search coil, with a total search unit power consumption of only 10 watts. This detection distance is sufficient to preclude any clearance problems with such vehicle-mounted units, namely there is no impairment of tank mobility. The clearance from the ground to the search coil can be increased, or the search coil moved closer to the tank, at the expense of more input power. Further tests with the same search coil mounted vertically, that is parallel to and 3 inches away from a continuous metal plate also mounted vertically, showed that a power input of less than 40 watts was sufficient to provide a 4-foot clearance of the plate and coil from the ground with successful detection of the kill signal. In this latter test, the mine simulator and the coil in it were oriented horizontally, as in the first test.

Figure 8:
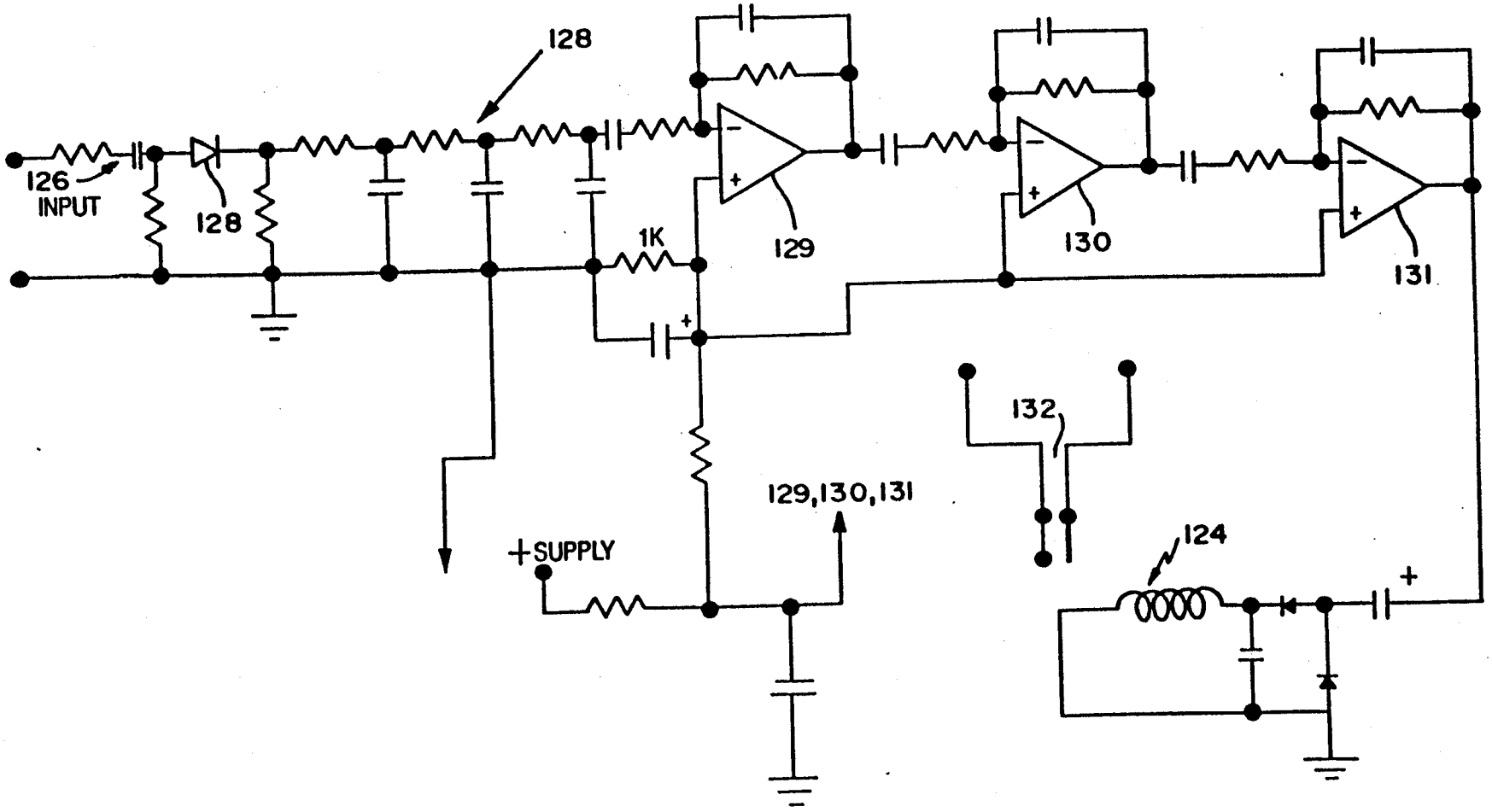
FIG. 8 shows schematically another embodiment of the receiver of the search unit, wherein a relay is activated to indicate reception of a kill signal.

FIG. 8 shows details of the circuitry of another embodiment of the receiver for the search unit, the output in this case being a relay 124 for indicating receipt of the kill signal. As in FIG. 7, a low frequency limiter 126 is followed by an rf detector which is in turn followed by a filter 128 for the rf, to pass only the audio frequencies of the kill signal to operate the relay. The illustrated components between the reed relay and the 3-stage audio amplification chain 129, 130, 131 act as an audio filter to prevent chattering of the relay 124. The relay can be connected to an alarm 132 or other kill-indication circuitry. Each stage of amplification is an ac coupled operational amplifier with additional low-pass filtering. As in FIG. 7, the dc supply is filtered and biased to define the operating points for the amplification stages. As for the receiver in FIG. 7, this receiver can be connected in a number of places for detecting the kill signal, including across the search coil, across the feedback winding of the Hartley oscillator powering the search coil, or across a small impedance provided in the power supply lead for the oscillator.

Figure 9:
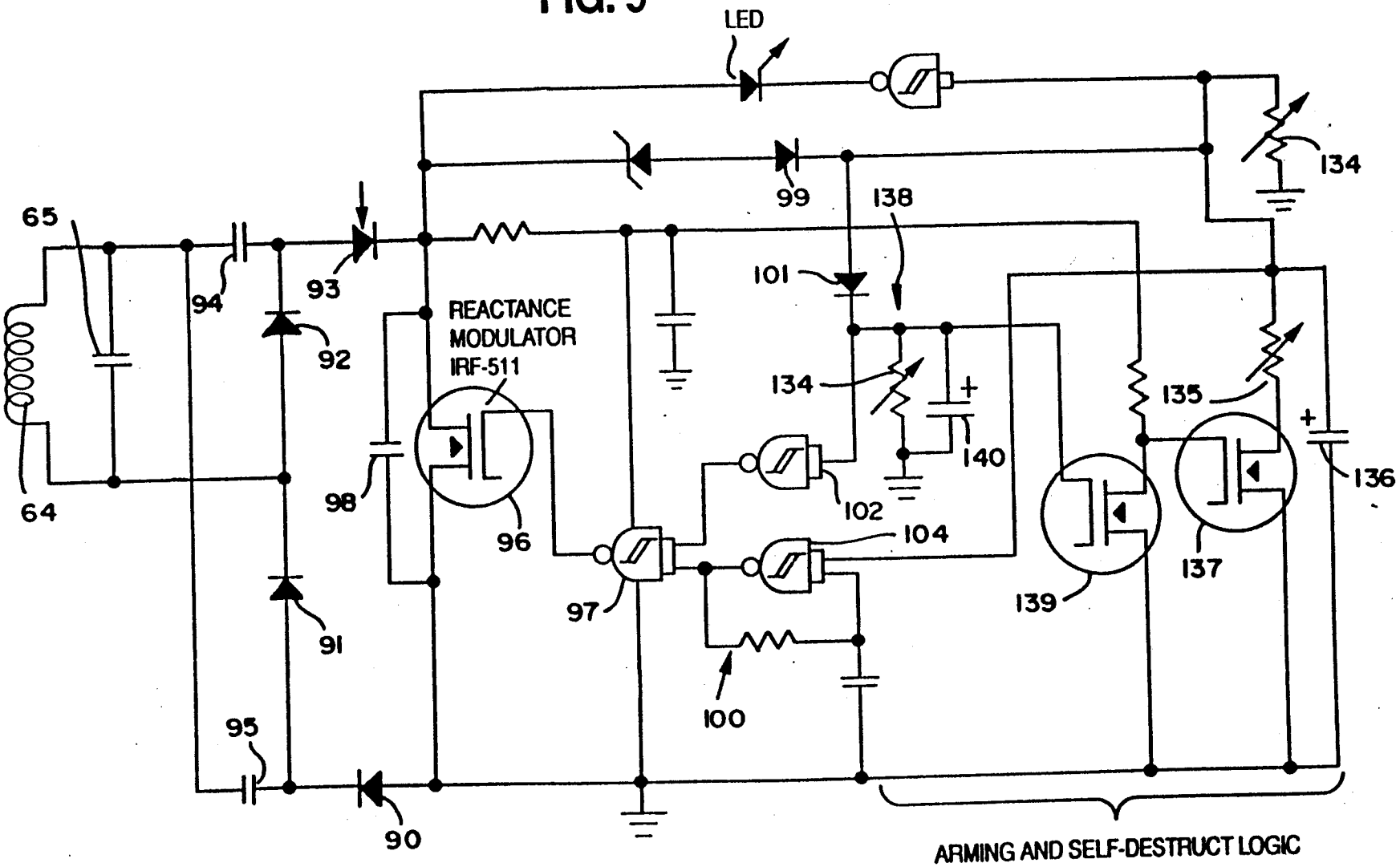
FIG. 9 shows schematically another embodiment of a mine simulator, with features for arming the mine simulator with strong magnetic induction to charge a timing capacitor, such as by placing the mine simulator against the search coil of a search unit, for limiting the active status period during which the mine is armed and can emit a kill signal, for limiting the length of the kill signal, and for selectably delaying the arming.

FIG. 9 shows details of the circuitry of another embodiment of the mine simulator according to the present invention. This circuit includes a Zener diode $D_z$ whose breakdown voltage is selected to be just somewhat less than the induced voltage at the rectifier output, when the mine simulator is placed directly against the search coil. By thus immersing the mine simulator in the field of the search coil, for instance for 45 seconds, the 0.1 f timing capacitor 94 is charged. While this capacitor is charging, this is visually indicated through a window by a light emitting diode LED as driven by one buffer stage of the indicated chip device.

While the mine simulator is armed, the passage of a tank 75 with a transmitting search unit 60 will cause a kill signal to be emitted from the mine simulator 62. The duration of this active or armed state is controllable by varying the 1 MΩ variable resistor 134, which bleeds to ground the charge on the timing capacitor 136. The mine thus will automatically self-destruct, that is, go into an inactive status, after a selectable period, for instance a predetermined number of days.

An arming delay time adjustment 138 can also be provided, such as with the illustrated 100 kΩ variable resistor 139 and 100 μf capacitor 140, to allow planting the mine simulator in the ground, withdrawal of the vehicle with the search coil, or any other reason for delay, before the mine simulator becomes armed or active, namely before it will issue the kill signal. The arming delay in the circuit as illustrated also allows charging of the timing capacitor without wasting power on generating the kill signal, as a result of deactivating the final stage of the buffer 97 which drives the power FET which is the reactance modulator 96. Such an arming delay period might be a few seconds, minutes or hours, depending on the situation.

In the embodiment of FIG. 9, the audio modulation of the reactance occurs, when a vehicle with a search unit approaches sufficiently close to the mine simulator 62 to sufficiently energize the pickup coil 64 and accordingly the audio oscillator 100, while the mine simulator 62 is in the armed status. To prevent more than one tank 75 from being killed by the same mine simulator 62, the length of the kill signal period can be limited as by the illustrated variable 1 kΩ resistor 135. This variable resistor 135 allows the timing capacitor 136 to discharge through a first power FET 137 (shown as an IRF511) connected in series with this variable resistor 135. This first power FET 137 becomes conductive only when the power derived from the induction field of a search unit on a moving tank becomes sufficient to result in a kill signal being sent out. At other times, that is, when the timing capacitor is being charged by breakdown in the Zener diode $D_z$ or while the armed mine simulator is waiting to detect the field of a search coil on a moving tank, this first power FET 137 is non-conducting.

This first power FET 137 (IRF511) is switched on by its gate, to allow the discharge of the timing capacitor 136 and to thereby limit the kill signal period, depending on the conducting or non-conducting state of the second power FET 139 (VN10KM) which acts as a high impedance inverter. The second power FET 139 becomes conductive, to ground the gate of the first power FET 137, only during the initial charging of the timing capacitor 136 and the subsequent arming delay period. This effectively allows only one kill signal to be emitted and avoids the situation of a second search unit on another tank receiving a kill signal when it subsequently runs over the mine simulator 62. In this manner, or any other suitable manner limiting the total number of kill signals sent and/or their duration, the number of kills per mine simulator can be selected.

These functions of arming and disarming the mine simulator, and of limiting the kill signal, enable or disable the simulator oscillator/modulator for predetermined times. Other functions could also be provided for, and in other types of devices, including real mines. The diodes 90–93 and 99 and 101 in FIG. 9 are Schottky diodes, such as 1A/50PIV or 1N914 diodes. The timing capacitor 136 is electrically relatively very large, but nevertheless physically very small.

Figure 10:
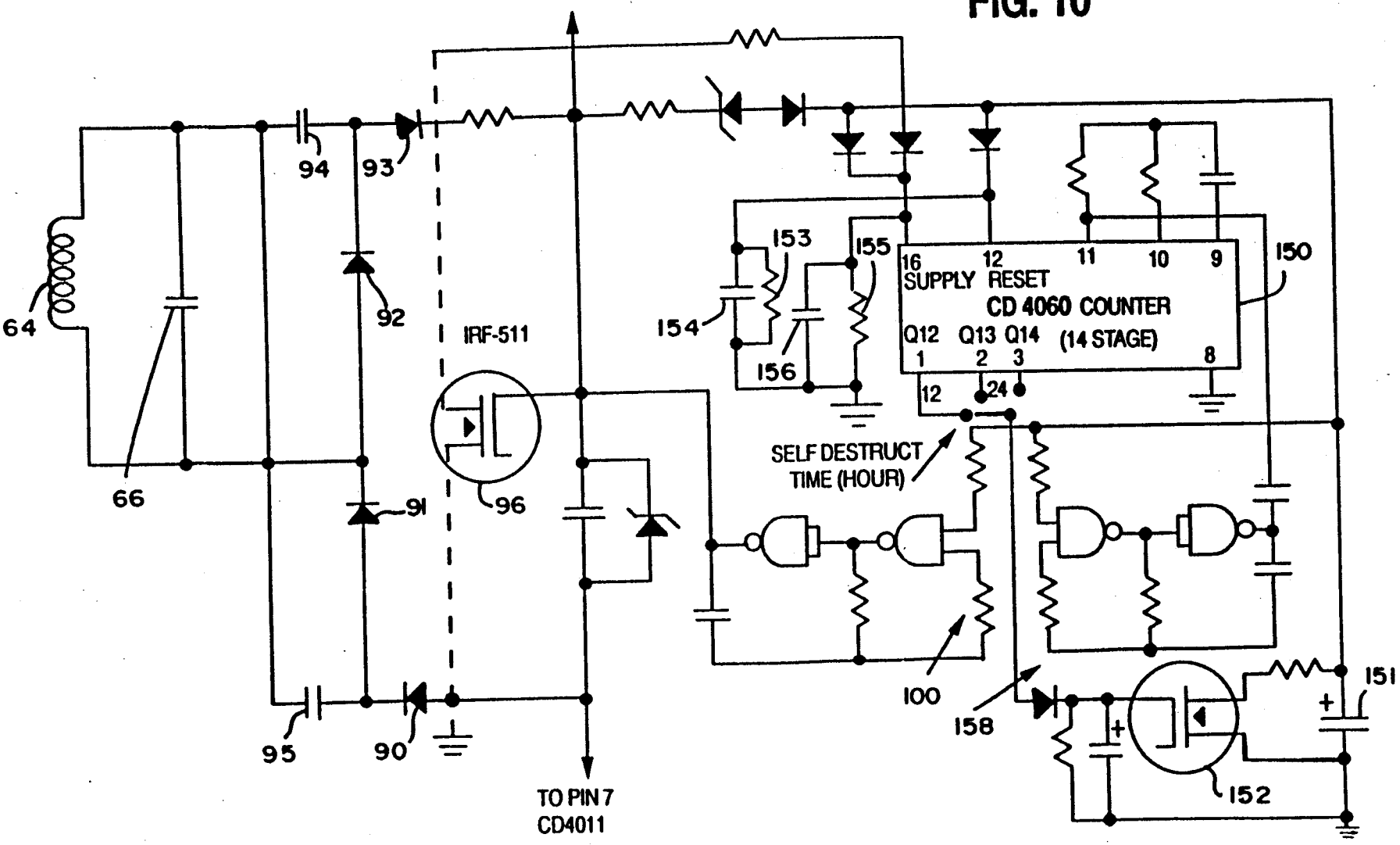
FIG. 10 shows schematically another embodiment of a mine simulator with features of the simulator of FIG. 9, employing a counter powered by a charged capacitor to determine the active period when the simulator is armed, in which the counter is switched to a fast-count mode during which the kill signal occurs, after which the simulator is inactive until it is similarly reset by strong magnetic induction coupling.

FIG. 10 shows circuit details of another embodiment of the mine simulator according to the present invention, wherein the period during which the mine is active or armed is determined by the counting of a counter 150 of for instance the indicated type (CD4060). The counter 150 is driven by power initially stored in a large capacitor 151 (0.1 f) by immersion in the induction field as in the case with the embodiment of FIG. 9. When a predetermined count value is achieved by the counter, the charge stored in the large capacitor 151 is discharged through a power FET 152 which may be an [IRF-511 indicated]. The circuit parameters are chosen so that the passage of a vehicle with an oscillating search unit cannot recharge the large capacitor 151 since it will be unable to reset the counter 150, as a result of a voltage booster effect of illustrated resistor 153 (100 kΩ) and capacitor (100 μf) connected in parallel to the reset input 12 of the counter.

A similar booster arrangement of a parallel resistor 155 and capacitor 156 is connected to the supply input 16 of the counter 150, for voltage supply to the counter during a fast-counting mode of the counter, corresponding to the kill signal. Namely, while the counter is counting after the device has been armed, the passage of a vehicle with an active search unit causes the activation of the audio oscillator 100 and the fast-counting oscillator 158, the former causing the kill signal to be emitted and the latter causing the counter to increase drastically its rate of counting, to rapidly reach the preset maximum count value. When the maximum count value is attained, the kill signal ceases and the mine simulator goes inactive until it is reset by again holding the mine simulator against the search unit of a vehicle. In other words, the mine simulator effectively self-destructs after one kill. To reset, it is necessary that the voltage on the reset input 12 drop to a low value, for instance 0.8 v.

According to the invention, low-frequency magnetic induction can thus be used to both transmit power to the mine simulator and to receive the kill signal from the mine simulator. The wireless power transmission from the vehicle which is running over the mine simulator eliminates the need for batteries in the simulated mine. Other monitoring and control functions could be similarly provided for, in a new generation of smart mine devices, whether actual mines or mine simulators. The communication with the mine device need not be limited to the kill signal, nor to the magnetic induction coupling, since the mine device could also transmit other types of signals, its status could be controlled and interrogated, etc.

In concept, any change in the reflected impedance of a secondary loop in an isolated object, as seen in the primary driven loop inductively magnetically coupled therewith, might be detectable, depending on the circumstances. As long as the change can be differentiated from any effect due to the motion of the primary loop with any magnetic object, then it can be seen as a change in the effective load, and as a signal containing information. Even a single step function change in the reflected impedance might suffice, depending on the signal-to-noise ratio, the response time of the circuitry, the relative stength of velocity induced effects, etc. In any case, where the resonating magnetic field is the carrier of the signal, the signal is necessarily of a lower frequency than the carrier. On the other hand, it is conceivable that the power transferred at the resonant frequency by the magnetic induction coupling would be used to generate a return signal from the mine device to the search unit that is at an entirely different frequency, and for detection by a means which is possibly totally separate from the primary loop and its associated resonance circuitry, which would thus be limited to information or at least power transfer to the isolated device.

Other examples of areas where the invention is useful include underwater instrument packages and deep submergence submarines, where it is desirable to pass power and data through a hermetically sealed hull or casing without requiring a break in the hull or casing that might cause structural weakening or leaking. Other applications where such a combined wireless power transmission/control/data retrieval system would be of possible use is in the ordnance field, where many missiles and proximity-fused shells do not have power for their circuitry prior to firing yet require a source of power for testing and fusing. Instead of the system of cables, plugs and connectors currently used for such testing and fusing in missiles and shells, the present invention would enable this testing and fusing procedures to be carried out without making any physical contact with the missile or shell. This would allow the speed at which such ordnance can be prepared for firing to be increased.

In the case of missiles, such a wireless system could be incorporated into the launcher, allowing its guidance system to be updated continually up to the point of the missile actually leaving the launcher without any problems with umbilical separation. In view of developments in non-conducting gun barrel systems it appears that this system could also be employed in certain gun systems for arming and fusing shells in the firing chamber, thereby eliminating some of the functions and perhaps some of the training required of a gun crew.

What is claimed is:

1. A system comprising a transportable search unit including a primary loop in which ac current is resonated to generate an oscillating magnetic field of at least one respective predetermined frequency, power supply means connected with said search unit for providing power to said search unit, including for said generating of said magnetic field, a mine device including a secondary loop for being inductively magnetically coupled with said primary loop and to resonate at said at least one predetermined frequency when said search unit approaches said mine device, power conversion means for deriving power from said resonating secondary loop, and signalling means powered by said derived power from said power conversion means for providing a signal indicating that said search unit attained sufficient proximity to said mine device as determined by the extent of the inductive magnetic coupling between said primary and secondary loops, and reception means transported with said search unit for receiving said signal, for indicating thereby said attainment of said sufficient proximity, wherein information is transferred from said mine device to said reception means at a frequency different from each said predetermined frequency of the resonation of the primary loop for the magnetic induction coupling with said secondary loop.

2. The system of claim 1, comprising said search unit having means including said primary loop for generating a plurality of said oscillating magnetic fields at a corresponding plurality of different predetermined frequencies, and said mine device having means including said secondary loop for detecting the inductive magnetic coupling therewith of each said oscillating magnetic field, wherein information is transmitted to said mine device from said search unit by said inductive magnetic coupling of said magnetic fields oscillating at said corresponding different predetermined frequencies.

3. The system of claim 2, wherein a succession of said oscillating magnetic fields of said corresponding different predetermined frequencies are generated by said search unit, for determining said information transmitted to said mine device.

4. The system of claim 2, wherein said search unit and said reception means are mounted on a vehicle, said mine device is a mine simulator, and said signal from said signalling means of said mine device is a kill signal, indicating that said vehicle came sufficiently close to said mine device to have set off a mine simulated thereby.

5. The system of claim 1, wherein said reception means comprises means at least connected with said search unit for detecting change in the reflected impedance in said primary loop of the impedance of said secondary loop in said mine device, as a result of said magnetic induction coupling, and said signalling means in said mine device comprises means for changing the impedance of said secondary loop, and accordingly said reflected impedance in said primary loop, said change in impedance caused by said signalling means comprising said signal provided by said signalling means for detection by said reception means.

6. The system of claim 5, wherein said mine device is a mine simulator, said search unit is mounted on a vehicle, and said reception means outputs a kill signal to the crew of said vehicle corresponding to said receiving of said signal from said mine device as a result of said changing of said reflected impedance.

7. The system of claim 6, wherein each said at least one predetermined frequency is and rf frequency, and said changing of said impedance of said secondary loop is repeated at an audio frequency, said repeated changing providing said kill signal.

8. The system of claim 7, wherein said reception means comprises a relay which is switched to provide said kill signal.

9. The system of claim 7, wherein said reception means comprises a speaker which is caused to emit a noise as at least a part of said kill signal.

10. The system of claim 1, said mine device comprising capacitor means for storing electrical energy for a time period during which it is desired that said mine device be in an active status, wherein said signalling means in said mine device provides said signal that said search unit has attained said sufficient proximity only while said mine device is in said active status, and wherein said electrical energy stored in said capacitor means is initially transmitted into said mine device for such storage by magnetic induction coupling with said secondary loop, by placing said mine device against said search unit.

11. The system of claim 10, said mine device comprising means for setting said desired active time period during which said mine device is in said active status.

12. The system of claim 11, said mine device comprising means for visually indicating the active status of said mine device at least during said initial transmitting of said electrical energy for storage in said capacitor.

13. The system of claim 11, said mine device comprising means for delaying the entry of said mine device into said active status for a selectable period of time after said initial transmission of said energy into said mine device for said storage therein.

14. The system of claim 1, wherein said search unit is mounted on a vehicle, said mine device is a mine simulator, and said signal from said signalling means of said mine device is a kill signal, indicating that said vehicle came sufficiently close to said mine device to have set off a mine simulated thereby.

15. The system of claim 14, said mine simulator comprising means for effectively limiting the number of kill signals said mine simulator will provide.

16. The system of claim 15, wherein said effective limiting of said number of kill signals occurs by limiting the total length of time that said kill signal is provided.

17. The system of claim 10, wherein said mine device comprises a counter powered by said electrical energy initially stored in said capacitor means, said counter being set to determine said active time period, and means for discharging charge remaining in said capacitor means after said predetermined count value is attained by said counter.

18. The system of claim 17, wherein while said counter is counting, corresponding to said mine simulator being in said active status, and said secondary coil subsequently commences to be magnetically inductively coupled with said primary coil as a result of said search unit attaining said sufficient proximity, said counter is switched into a fast counting mode and said signal is provided from said signalling means to said reception means as a kill signal which continues until said predetermined count is achieved.

19. The system of claim 18, said mine device comprising means for delaying the entry of said mine device into said active status for a predetermined period of time after said initial transmission of said electrical energy into said mine device for said storage therein.

20. The system of claim 1, wherein said search unit and said reception means are mounted on a vehicle, said mine device is a mine simulator, and said signal from said signalling means of said mine device is a kill signal, indicating that said vehicle came sufficiently close to said mine device to have set off a mine simulated thereby, said reception means comprises means at least connected with said search unit for detecting change in the reflected impedance in said primary loop of the impedance of said secondary loop in said mine device, as a result of said magnetic induction coupling, said signalling means in said mine device comprises means for changing the impedance of said secondary loop, and accordingly said reflected impedance in said primary loop, said search unit as mounted on said vehicle provides a clearance of up to 5 feet from the ground, while powering said mine simulator and receiving said kill signal, with a maximum power supplied to said search unit of 10 watts, and said primary coil in said search unit is approximately as wide as said vehicle, and approximately at least an order of diameter larger in linear scale than said secondary loop in said mine simulator.

* * * * *